US007854577B2

(12) United States Patent
Green

(10) Patent No.: US 7,854,577 B2
(45) Date of Patent: Dec. 21, 2010

(54) FREIGHT CONTAINER

(76) Inventor: Charles T. Green, 9624 Crosby Dr., Pleasanton, CA (US) 94588

( * ) Notice: Subject to any disclaimer, the term of this patent is extended or adjusted under 35 U.S.C. 154(b) by 841 days.

(21) Appl. No.: 11/798,420

(22) Filed: May 14, 2007

(65) Prior Publication Data

US 2007/0269284 A1 Nov. 22, 2007

Related U.S. Application Data

(60) Provisional application No. 60/801,392, filed on May 19, 2006.

(51) Int. Cl.
*B60P 7/08* (2006.01)

(52) U.S. Cl. ..... 410/32; 220/1.5

(58) Field of Classification Search ..... 410/31, 410/32, 35, 46; 220/1.5; 296/186.1; 108/185
See application file for complete search history.

(56) References Cited

U.S. PATENT DOCUMENTS

| | | | | |
|---|---|---|---|---|
| 3,310,925 | A | 3/1967 | Le Brun | |
| 3,830,381 | A | 8/1974 | Bodenheimer et al. | |
| 4,795,049 | A | 1/1989 | Alcorn | |
| 4,844,672 | A | 7/1989 | Yurgevich | |
| 4,930,426 | A | 6/1990 | Saxton et al. | |
| 5,072,845 | A | 12/1991 | Grogan | |
| 5,248,051 | A | 9/1993 | Yurgevich et al. | |
| 5,584,527 | A * | 12/1996 | Sitter | |
| 5,702,151 | A | 12/1997 | Grote et al. | |
| 5,816,423 | A | 10/1998 | Fenton et al. | |
| 6,183,176 | B1 * | 2/2001 | Weiner | 410/32 |
| D472,704 | S | 4/2003 | Bruderer | |

FOREIGN PATENT DOCUMENTS

| | | |
|---|---|---|
| DE | 3835671 | 4/1990 |
| EP | 0206542 | 5/1986 |

OTHER PUBLICATIONS

Website, http://www.containersales.com/dry_cargo.html, specifications on various dry cargo containers, one sheet printed from the internet on May 23, 2005.

(Continued)

*Primary Examiner*—Stephen Gordon
(74) *Attorney, Agent, or Firm*—Richard C. Litman

(57) ABSTRACT

The freight container is constructed with relatively thin sidewalls of relatively high-strength steel, permitting thinner corrugations. This results in a greater internal width for the container, while still having an external width not exceeding the nominal 102" or 2.6 meter national and international standards. By forming the sidewalls of sufficiently high strength materials, the sidewalls may be constructed to have a thickness not exceeding one inch each, thereby providing a nominal internal width of 100" for the container. This permits the placement of U.S. standard pallets having lengths and widths of 56×44 inches in an alternating array, with each pallet group forming a square of 100" on a side. In this manner, a total of twenty-four pallets may be placed within the freight container.

6 Claims, 8 Drawing Sheets

OTHER PUBLICATIONS

Website, http://www.mobilestorage.com/products/containers.htm, information on various containers from the Mobile Storage Group, two sheets printed from the internet on May 23, 2005.

Website, http:www.pbb.com/en/tools/container_size_charts/40-_wide-door/, specifications for 40 foot long container, one sheet printed from the internet on May 23, 2005.

* cited by examiner

FREIGHT CONTAINER

CROSS-REFERENCE TO RELATED APPLICATION

This application claims the benefit of U.S. Provisional Patent Application Ser. No. 60/801,392, filed May 19, 2006.

BACKGROUND OF THE INVENTION

1. Field of the Invention

The present invention relates generally to closed containers used for the transport and storage of goods. More specifically, the present invention relates to an intermodal freight container for use in over the road, rail, and oceanic shipment of goods.

2. Description of the Related Art

Relatively large freight containers for the interstate and international shipment of goods have evolved to a relatively few standard sizes. Most of the dimensions used for container construction are the result of federal government standards or requirements and/or international standards and agreements, as such containers commonly travel throughout the U.S. and the world. As a result, various regulations and agreements have been developed regarding the size and configuration of containers used for such shipments in order to facilitate the carriage of such containers by ship, rail, and truck.

One of the most critical standards is the maximum permissible external width of such containers, with the limitation being primarily due to maximum vehicle widths when such containers are used as semitrailers for over the road shipments. In the U.S., federal rules limit the maximum external width of a vehicle used in interstate commerce to eight feet, six inches (102") without a special permit. Most states have the same requirements. International standards are in very close agreement, limiting the external width of such containers to 2.6 meters, or about 102.36 inches. This 2.6 meter (102.36 inches) maximum width is seen to meet the U.S. standard of 102".

No standards have been developed for the internal dimensions of such containers. The internal dimensions and resulting volume are strictly up to the manufacturer of the container so that the thickness and dimensions of the container depend upon the materials used to construct the container. However, a container with maximized internal dimensions is generally desired, in order to maximize the volume of cargo or freight that may be carried therein.

The standard freight container sidewalls are commonly constructed of relatively mild steel for economy, and as a result must use relatively thick steel panels having relatively deep corrugations to provide the required strength. Typically, the walls of a conventional container are nearly two inches thick, generally being within about one sixteenth of an inch of that dimension. The result is that the two sidewalls of the container take up nearly four inches of lateral width, limiting the internal width of the container to about 98.5 inches. While this may not seem to be a great deal of difference when the maximum permissible overall width of 102.36 inches is considered, it can make the difference between a load that just fits laterally within the container and another load configuration that results in a considerable amount of wasted interior volume in the container.

As intermodal containers have become standardized, so also have pallets used for the carriage of loads within such containers. Certain international standards have been developed for the horizontal dimensions of such pallets, with the standard dimensions being 80×120 cm (31.5×47.24 inches) and 100×120 cm (39.37×47.24 inches). In addition to these international standards, a de facto standard used in the U.S. is 44×56 inches. The 44×56 inch pallet finds use almost entirely in the U.S., with this pallet size seeing practically no international use.

The internal width of conventionally constructed containers is about 98.5 inches, as noted further above, or about 2.502 meters. As a result, it is impossible to fit conventional pallets of any standardized size or shape across the width of a conventional container without incurring considerable wasted lateral space. Two international standard pallets, each having a length of 120 cm (1.2 meters), may be placed laterally end-to-end to span 2.4 meters across the 2.5-meter internal width of a conventional container, with the resulting 0.1 meter (about 3.94 inches) not being particularly significant. Similarly, three international standard pallets may be placed side-by-side to span 2.4 meters.

However, the de facto U.S. standard size pallet of 44×56 inches cannot be conveniently arranged within the 2.5-meter or 98.5 inch nominal internal width of a conventional intermodal freight container. The placement of such pallets with their largest dimensions disposed laterally within the container results in over thirty inches of unused lateral space. The placement of two such pallets side-by-side is somewhat more efficient, resulting in a total width of 88", but this still results in over ten inches of wasted lateral space within the container. When such pallets are placed longitudinally within a conventional container, their 56" lengths define the number of pallets that may be placed longitudinally within a container. A conventional 53-foot long container has an internal length of about 52', 8", or about 632". A total of eleven pallets placed end-to-end have a total length of 616", leaving about sixteen inches of unused space for two rows of eleven pallets each, or twenty-two pallets in a 53-foot long conventional container.

However, if the container could be widened internally to span 100", then U.S. standard pallets could be staggered with one pallet placed longitudinally and another placed laterally alongside. The total width of such an arrangement is 56" plus 44", or 100". Groups of four pallets may then be arranged in square planforms of 100" on a side, i.e., "pinwheeled," to fill all of the available lateral space in such an internally widened container, leaving only a twelve-inch square open area within each group of four pallets. Six such groups of four pallets in each group would comprise twenty-four pallets having a total length of 600", and could be placed easily within the 632" internal length of a 53-foot long container. This would result in about nine percent more palletized freight capacity for such a container using U.S. standard pallets of 44×56 inches for an increase in internal container volume of only about one and one half percent, with the greater capacity resulting in a corresponding increase in profitability for the shipping company.

A number of different freight container configurations have been developed in the past, as noted further above. An example of such is found in German Patent No. 3,835,671, published on Apr. 26, 1990, which describes (according to the English abstract and drawings) the use of panels cut from a roll of sheet metal having a standard width for the construction of a container. The panels are cut to lengths equal to the height of the container, and assembled along their mutual lateral edges to form the desired length for the container.

None of the above-described inventions and patents describes the instant invention as claimed. Thus, a freight container solving the aforementioned problems is desired.

SUMMARY OF THE INVENTION

The freight container has lateral walls formed of relatively high-strength steel panels, which permit the corrugations to be shallower than conventional corrugated steel walls used in the construction of conventional freight containers. The thinner corrugations result in walls having a nominal thickness of only about one inch each, as compared to conventionally constructed container sidewalls having a thickness of about two inches each. The thinner walls of the freight container result in an internal width fractionally greater than 100", while still meeting the maximum permissible external width of eight feet, six inches, or 102 inches (102.36 inches or 2.6 meters, for international standards).

The relatively thin wall construction of the present invention permits the placement of U.S. standard pallets having lengths and widths of 56×42 inches in an alternating longitudinal and lateral array or configuration within such a container. The result is that twenty-four pallets may be placed within a 53-foot long container having an internal width of 100", as opposed to only twenty-two pallets fitting within a 53-foot long container having a conventional internal width of only 98". The resulting nine percent increase in pallet capacity correlates directly to a corresponding increase in profits for the shipping company.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
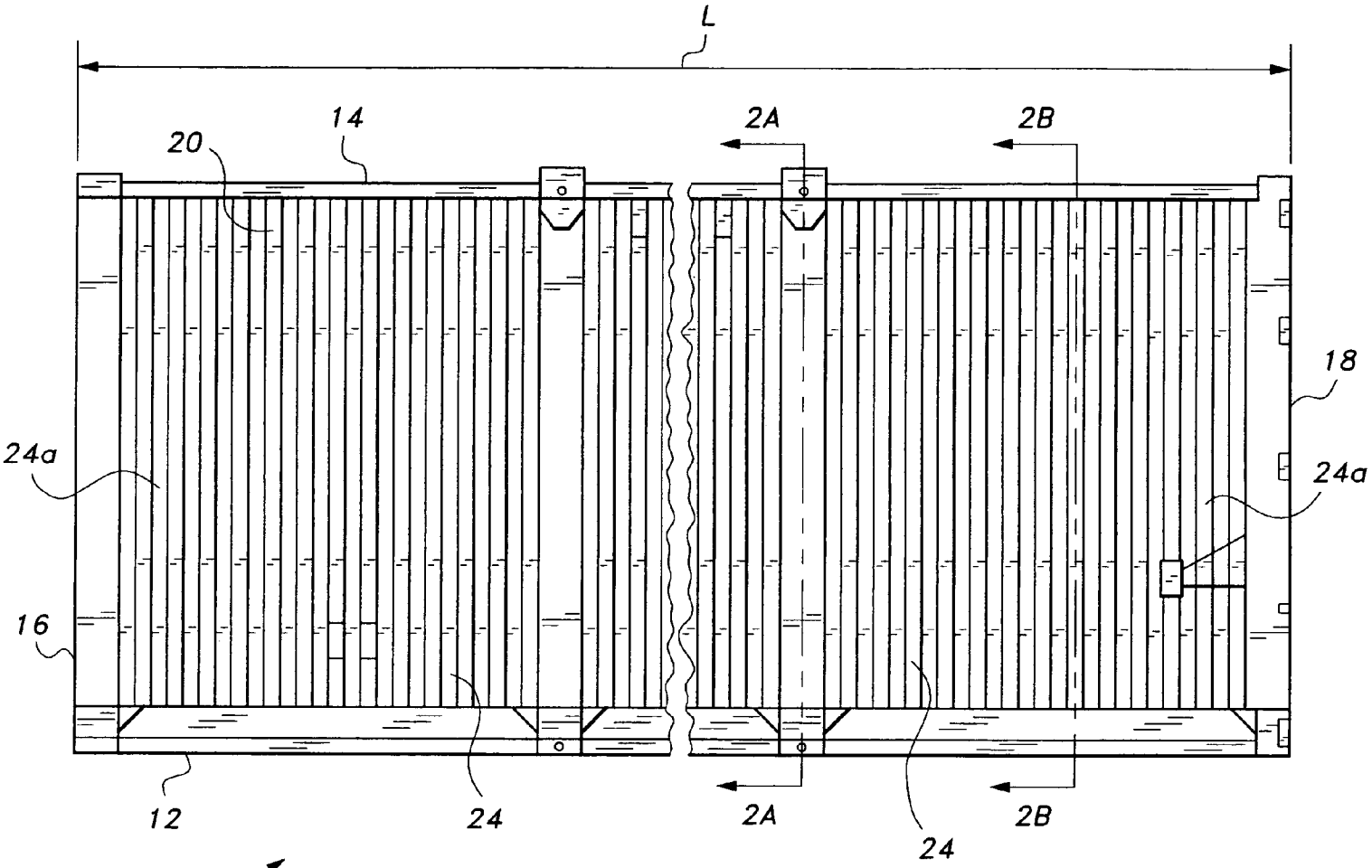
FIG. 1 is a side elevation view of a freight container according to the present invention, with the central portion broken away to allow enlargement of the remainder of the illustration.

The present invention comprises an intermodal freight container having specially configured sidewalls of thinner than conventional construction, thereby providing additional internal lateral space and volume while still remaining within the maximum permissible external width limits for such containers. FIG. 1 provides a side elevation view of the freight container 10 of the present invention, illustrating its general configuration and features, with FIGS. 2A and 2B respectively providing further elevation views in section along lines 2A-2A and 2B-2B of FIG. 1. The container 10 includes a floor 12, a roof 14, a first end wall 16 extending from the floor to the roof, and an opposite second end wall 18 extending from floor to roof. The second end wall may include doors and may comprise the rearward end of the container 10 when the container is used as an over-the-road semitrailer. Opposite first and second sidewalls, respectively 20 and 22, extend from the floor 12 to the roof 14 and from the first end wall 16 to the second end wall 18 to complete the enclosed structure.

Figure 4:
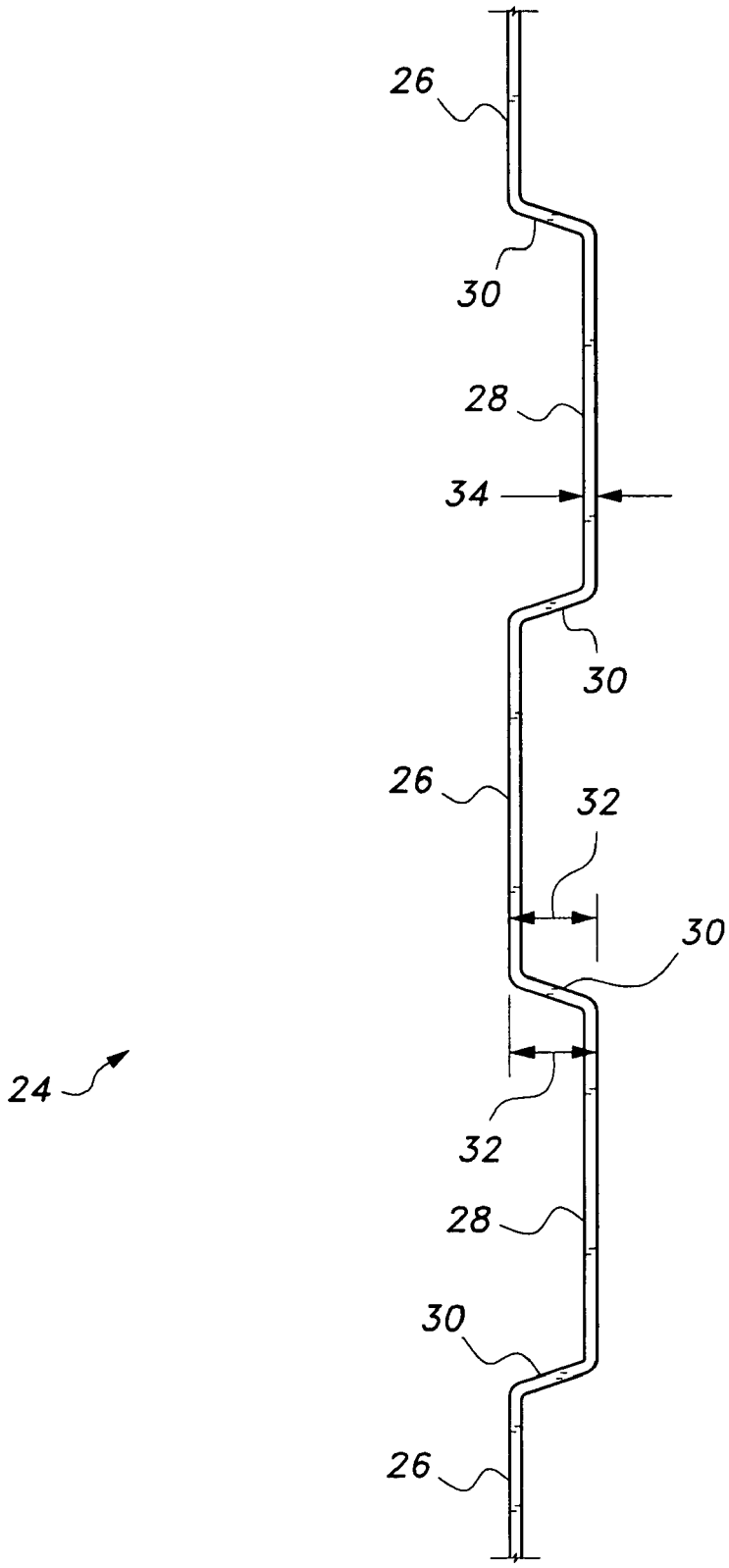
FIG. 4 is a diagrammatic plan view of a thin wall corrugated panel used in the construction of the freight container of the present invention.
Figure 7:
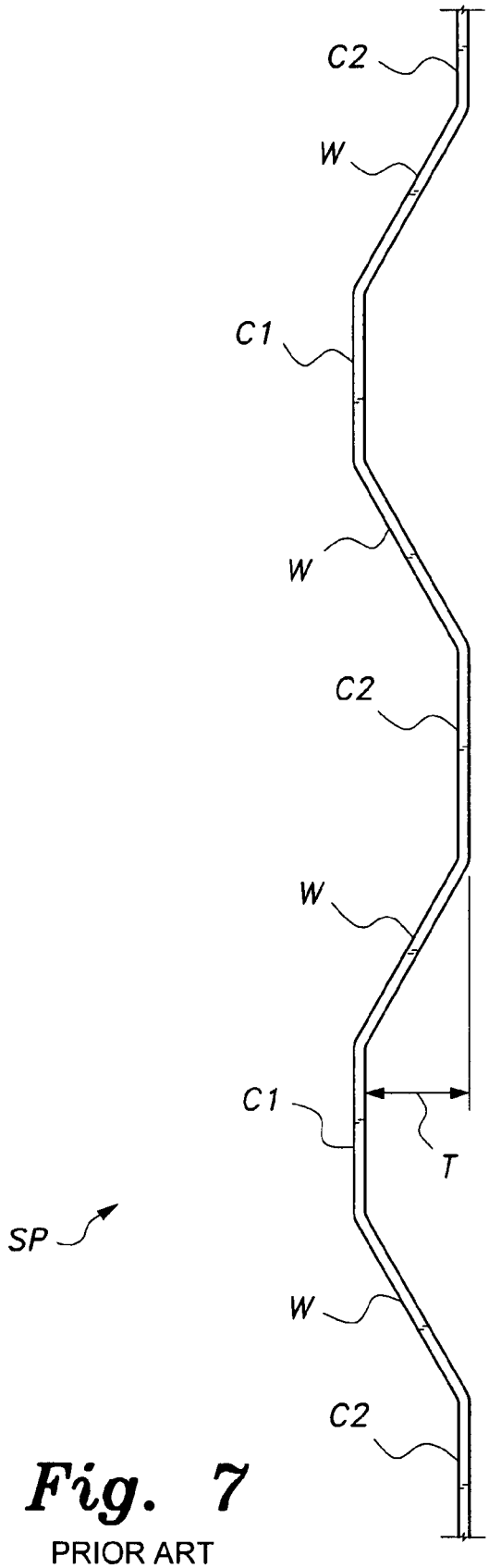
Fig. 7 PRIOR ART
FIG. 7 is a plan view of a corrugated panel used in the construction of freight containers of the prior art, showing its additional thickness in comparison to the thin wall corrugated panel used in a freight container according to the present invention, e.g., as shown in FIG. 4.

Each sidewall 20 and 22 is formed of a series of panels of high-strength corrugated steel sheet material. An exemplary panel section 24 is illustrated in FIG. 4 of the drawings. The corrugations of the sidewall panels 24 are considerably thinner than those of conventional sidewall panels SP, an example of which is shown in FIG. 7. The sidewall panel 24 of the thin wall freight container 10 is formed of a high-strength steel sheet in comparison to the relatively mild steel used in the construction of conventional sidewall panels SP. The panel 24 preferably uses a steel alloy manufactured by SSAB Tunnplat of Sweden, known by the trade name Domex®. Domex® steel is provided in several different alloys, but each includes a relatively high percentage of manganese, on the order of 1.5 to 1.9 percent, and has a relatively high yield strength. For example, Domex® 600MC has a minimum yield strength of $600\times10^7$ Pascals, or about 87,000 pounds per square inch (87 ksi). Other steels having equivalent or greater yield strengths may be used in the construction of the freight container 10.

In comparison, conventional freight containers are constructed of a relatively weaker steel, such as Cor-Ten®, manufactured by the U.S. Steel Company, primarily for reasons of economy in manufacture. Cor-Ten® has a yield strength of about $420\times107^7$ Pascals, or about 61,000 pounds per square inch. This necessitates deeper corrugations and/or thicker sheet metal for containers constructed using Cor-Ten® steel in order to provide the required strength for the sidewalls.

The sidewall panel 24 of the present invention, as shown in FIG. 4, is formed of a series of relatively shallow, flat, parallel corrugations. The alternating first and second corrugations, respectively 26 and 28, respectively span 100 mm and 103 mm, and are staggered from one another by steeply-angled intermediate connecting webs 30. The connecting webs 30 have heights of about seventeen millimeters or about ⅔ of an inch, which define the depth 32 of the alternating corrugations 26 and 28 and corresponding overall thickness of the panel 24 and sidewalls 20 and 22 constructed therefrom, and spans of about five millimeters along the plane of the corrugations 26 and 28. The thickness 34 of the panel sheet is preferably about one millimeter for most panels 24 between the two ends 16 and 18 of the container 10, but preferably increases to 1.2 millimeters for the panels 24*a* adjacent the two ends 16 and 18 of the container 10.

In contrast, the conventional prior art sidewall panel SP of FIG. 7 is formed of a series of relatively short corrugations C1 and C2 having respective flat spans of only 72 and 70 millimeters. These corrugations are joined to one another by a corresponding series of relatively deep intermediate webs W having depths of 36 mm and relatively wide spans of 68 mm. The resulting slope of 36/68, or about 53%, is considerably shallower than the 17/5 or 340% slope of the connecting webs 30 of the panel 24. This, along with the weaker steel alloy from which conventional container sidewall panels SP are constructed, necessitates a considerably deeper corrugation and wall thickness T for such panels SP in order to provide the required stiffness.

Figure 2A:
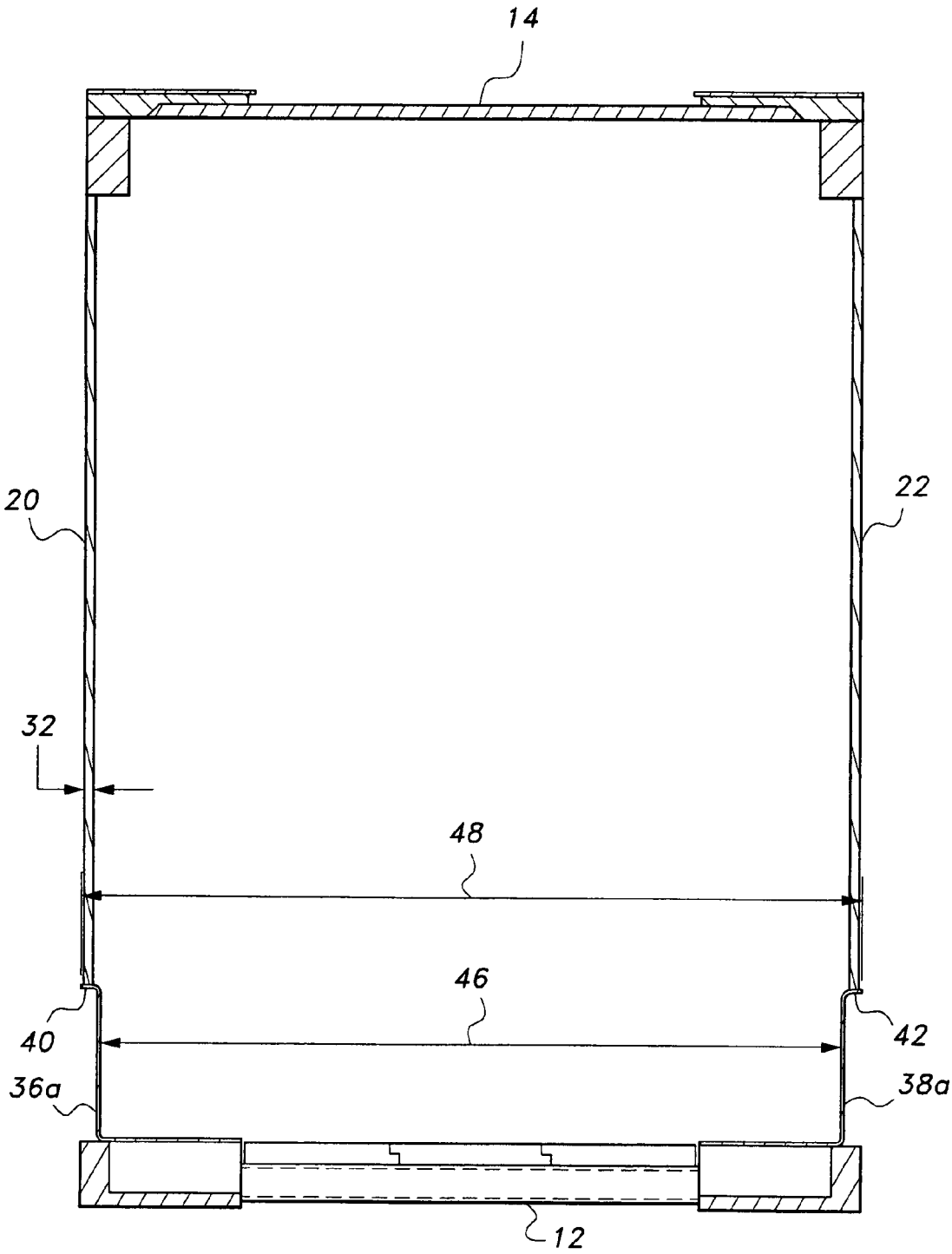
FIG. 2A is a section view along lines 2A-2A of FIG. 1, showing further details of the container.
Figure 2B:
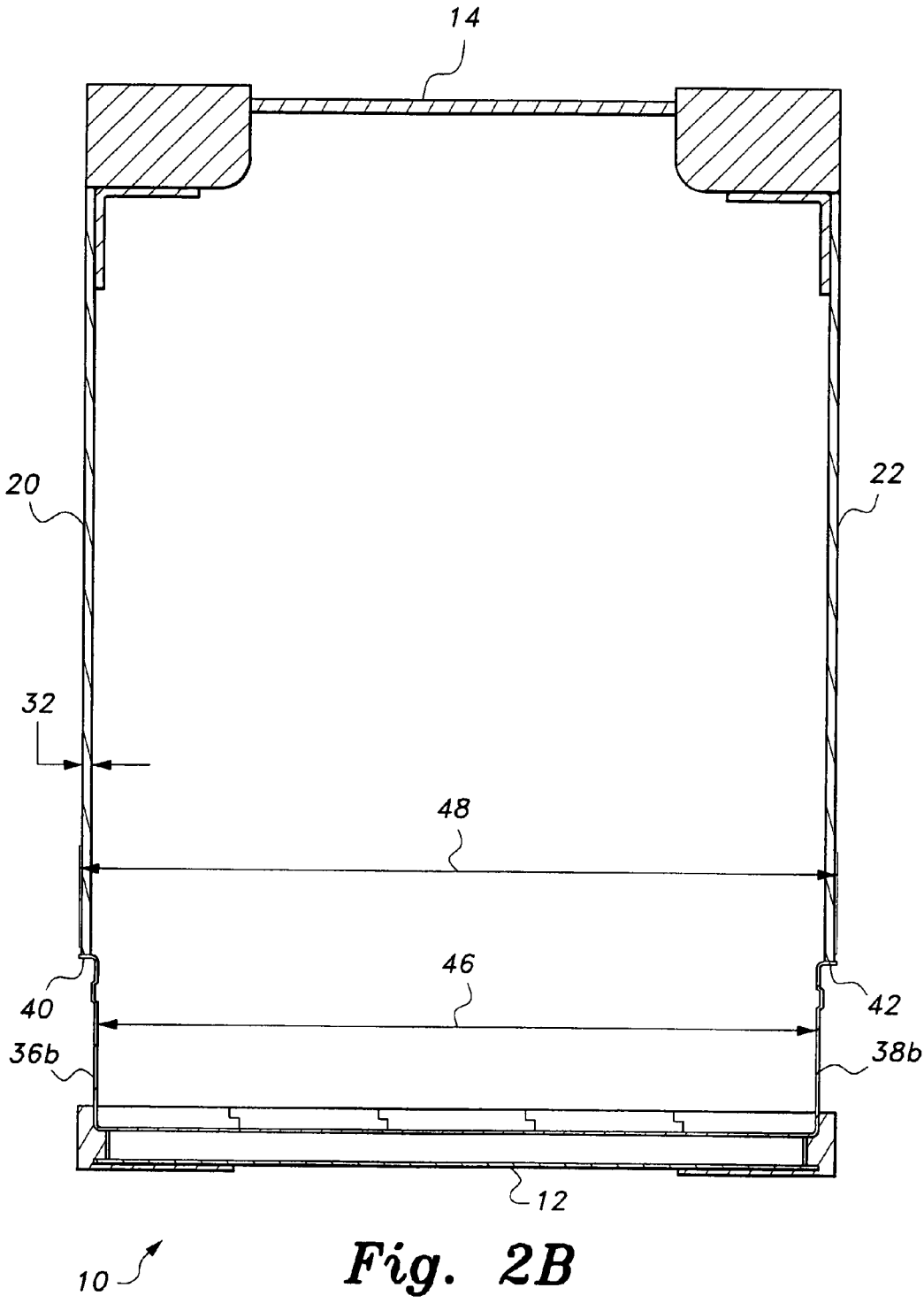
FIG. 2B is a section view along lines 2B-2B of FIG. 1, showing further details of the container.
Figure 3:
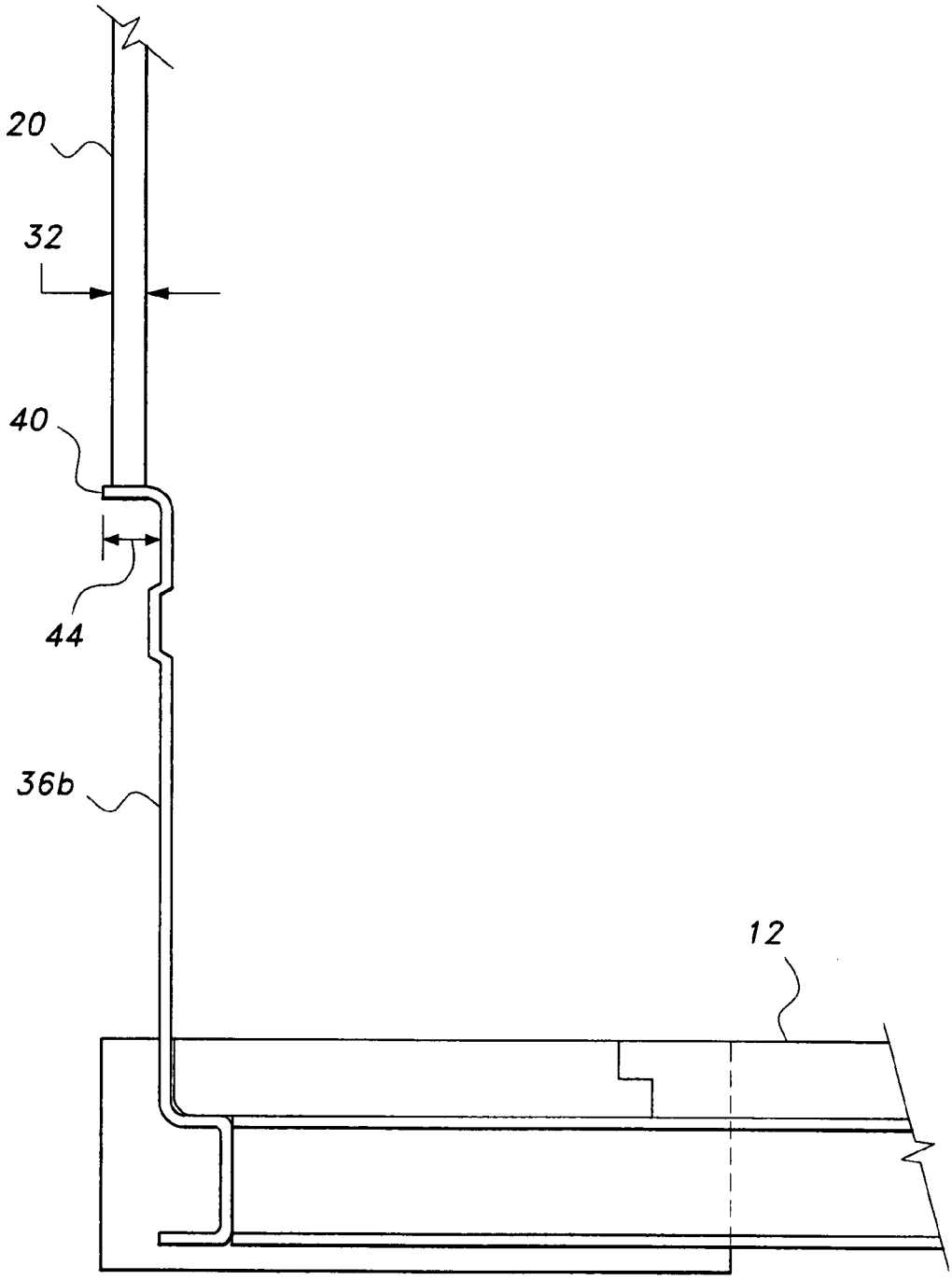
FIG. 3 is a partial elevation view in section of one corner of the freight container of the present invention, showing further details of the structure of the container.

It will be noted that the overall wall thickness 32 defined by the height of the interconnecting webs 30 of the present wall panel 24 is only about 2/3 of an inch, as noted further above. The conventional panel SP has an overall wall thickness of 36 mm, or about 1.42". This overall panel thickness is somewhat less than the one-inch and two-inch nominal thickness noted further above respectively for the sidewalls 20, 22 and conventional sidewall panel P. This is due to the additional structure to which the sidewall panels are attached, particularly at their bases. FIGS. 2A, 2B, and 3 illustrate cross-sectional views of the first sidewall 20 of the freight container 10 and its connection to the base structure joining the sidewall 20 to the floor structure 12, with FIG. 6 providing an illustration of the conventional sidewall and corner structure.

Figure 6:
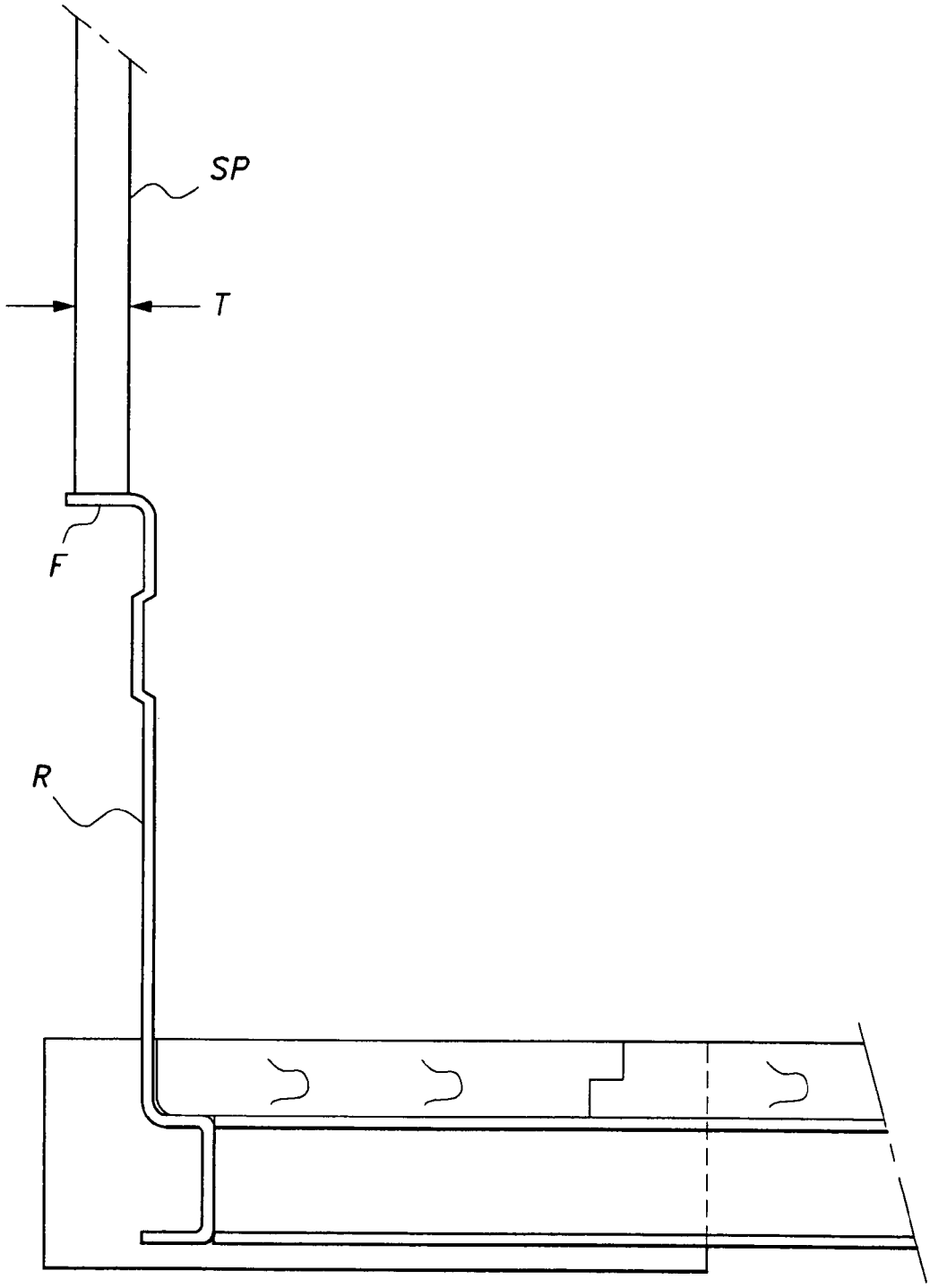
Fig. 6 PRIOR ART
FIG. 6 is a partial elevation view in section of one corner of a freight container of the prior art, showing the additional wall thickness thereof in comparison to the corresponding detail view of a freight container according to the present invention as shown in FIG. 3.

The sidewall panels of the freight container 10 and prior art freight containers are both attached at their bases to a base rail member, e.g., rail member R in prior art drawing FIG. 6, which extends along the length of the container and serves to attach the corrugated wall panel to the floor structure. The rail member includes an upper horizontal flange F, which supports the lower edge of the corrugated side panel. In the case of the conventional structure shown in FIG. 7, the thickness T of the panel SP necessitates a relatively wide horizontal flange F, with the flange F having a horizontal width of 48 mm, or nearly two inches in conventional container construction. As the external edges of the two flanges of the opposite rail members are limited by regulation to a maximum width of no more than 2.6 meters (102.36 inches), the rail member walls R supporting the internal edges of these flanges F can have a lateral span therebetween of no more than about 98".

In contrast, the freight container 10 shown in detail in FIGS. 2A, 2B, and 3 provides a significantly greater internal width due to the narrower or thinner walls 20 and 22 and their support structures or bases. Each wall 20 and 22 is supported by a rail member, respectively 36*a* and 38*a* (or 36*b*, 38*b* in FIG. 2B), with each rail member having an outwardly turned, horizontal wall support flange, respectively 40 and 42, extending therefrom. This construction is similar to that described for the prior art container construction shown in FIG. 6, and discussed further above. However, the thinner wall panels 20 and 22 result in narrower support flanges 40 and 42 being required, with each support flange 40 and 42 having a horizontal span 44 (shown in FIG. 3) of only 20 mm, or slightly less than 0.8 inch. As the external edges of the support flanges 40 and 42 may be "pushed out" to the extreme regulatory limits for the maximum external width of the container 10, i.e., 102.36 inches, it will be seen that the subtraction of the widths of the two support flanges 40 and 42, and the thickness of their sidewalls 20 and 22, remove a total of less than two inches from the remaining internal width or span of the container, resulting in an internal width or span 46 of fractionally more than 100" across the narrowest portion of the container between the two rails 36*a*, 38*a* (in FIG. 2A) or 36*b*, 38*b* (in FIG. 2B). The nominal internal span 46 between the lower side rails of the freight container 10 is about 100.37 inches, or about 2,550 millimeters, depending upon tolerances during manufacture. In any event, the internal span 46 will always be at least 100", which expands the loading possibilities and configurations for the freight container 10 considerably, as described below and shown in FIG. 5 of the drawings.

Figure 5:
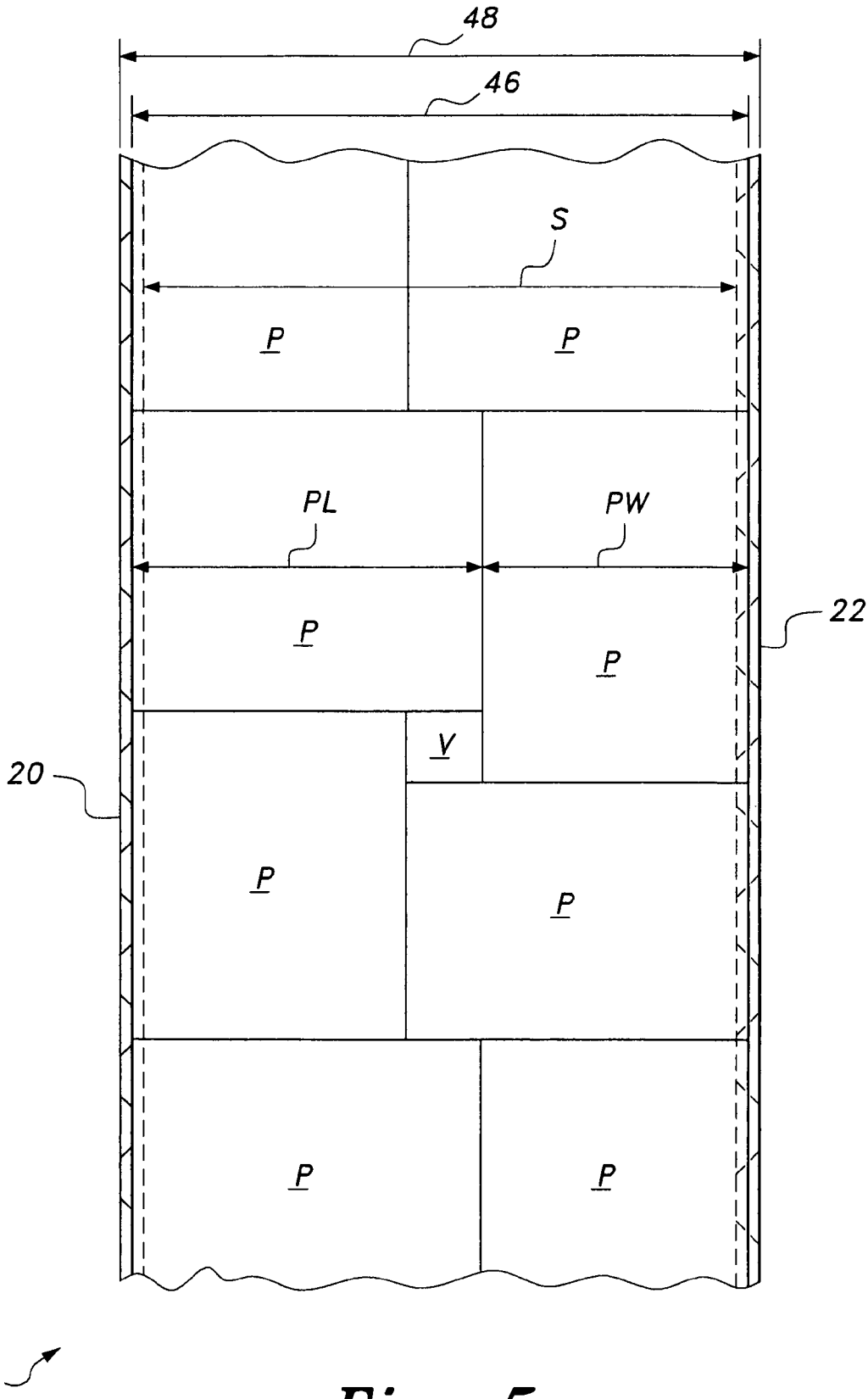
FIG. 5 is a diagrammatic top plan view of an exemplary pallet-packing configuration made feasible by the interior width the freight container of the present invention.

FIG. 5 provides a top plan view of a section or portion of the internal volume or space within the freight container 10 between the two sidewalls 20 and 22. The sidewalls 20 and 22 have a maximum external width or span 48 of at least 102", and generally fractionally greater than 102", as noted further above. The thin sidewalls 20 and 22 result in an internal lateral width or span 46 of at least 100", as noted above. This permits the efficient placement of palletized loads of standard U.S. pallets P thereon. Such U.S. standard pallets P have widths PW of 44", and lengths PL of 56". It will be noted that the width PW (44") and length PL (56") of a pallet P add up to 100", or fractionally short of the 100-plus inch interior span or width 46 of the thin wall container 10.

The pallets P are loaded efficiently within the thin wall container 10 by placing laterally adjacent pallets in alternating length and width configuration, i.e., with one pallet having its length PL extending across the internal span of the container, and the laterally adjacent pallet having its width extending across the remaining span of the container. The longitudinally adjacent pallets are again alternated or staggered relative to their lengths and widths, i.e., with the major axis or length normal to that of the adjacent pallet. This results in a "pinwheel" configuration, with the lengths of the adjacent pallets in a group of four pallets being normal to one another. Each group of four pallets P thus forms a square with sides equal to the additive total of the length and width of a pallet, i.e., 44"+56", or 100", essentially the same dimension as the internal width 46 of the thin wall container 10. This results in a small unused volume V of twelve inches on a side in the center of each group of four "pinwheeled" pallets P, but the overall result still allows a greater number of standard U.S. pallets P to be placed aboard a thin wall freight container 10 than is possible with conventional freight containers.

FIG. 5 also illustrates the internal lateral span S of a conventional container, with the internal surfaces of the walls defining that span S being shown in broken lines. It will be noted that the total lateral span PL+PW of the "pinwheeled" pallet configuration exceeds the lateral interior span S of the conventional container. Thus, the only way of placing two standard pallets P laterally adjacent to one another in a conventional container is by orienting them with their minor dimensions PW extending laterally across the interior of the container. As the two pallet widths PW total only 88", it will be seen that an unused space or volume of about ten inches will extend the length of the container.

In the case of a freight container having an external length L of 53', as shown in FIG. 1 and conventional for most such units, the internal length available is about 632" when the two-inch nominal thickness of the forward and rearward ends of the container are subtracted. Eleven pallets subtend a total length of 616", which allows a total of twenty-two pallets (two rows of eleven pallets each) to be placed in such a conventional freight container with sixteen inches of unused longitudinal space remaining. In contrast, the "pinwheel" configuration permitted for palletized loads using the freight container 10 results in a series of groups of four pallets to a group to be loaded aboard such a container 10. Each group of four pallets results in a square planform having 100" on a side. Thus, a series of six such pallet groups placed longitudinally in such a freight container 10 would subtend a total length 600", fitting easily within the 632" internal length of a 53-foot long container. The resulting load comprises six groups of four pallets per group, or twenty-four pallets total. This is some nine percent greater load than permitted by a conventional container, provided by increasing the internal lateral span of the container 10 by only some two percent or less.

In conclusion, the freight container 10 provides a significant improvement in its capacity to carry palletized freight using U.S. standard pallets in comparison to conventional freight containers having narrower internal widths. The construction of the sidewalls of the present container requires the use of high-strength steel alloys and corrugation configurations not previously considered to be economically viable in the industry. However, the relatively slight improvement in lateral internal span for the freight container 10 by means of such high-strength steel and special thin corrugation pattern results in the ability to provide a considerably more efficient loading configuration for such palletized cargo or freight. The result will be much appreciated in the shipping industry, where the ability to load nearly ten percent more pallets in a container having the same external width and length as conventional containers will result in correspondingly greater profits and/or the lowering of unit shipping costs for customers and subsequent attraction of more business for the shipping company.

It is to be understood that the present invention is not limited to the embodiment described above, but encompasses any and all embodiments within the scope of the following claims.

I claim:

1. A freight container, comprising:

a floor;

a roof;

a first end wall extending from the floor to the roof;

a second end wall extending from the floor to the roof opposite the first end wall; and mutually opposed first and second sidewalls extending from the floor to the roof and from the first end wall to the second end wall, the first and second sidewalls being made of high-strength steel having a yield strength of at least about 87,000 pounds per square inch, the sidewalls having a thickness up to one inch and defining an internal span therebetween of at least one hundred inches;

wherein the first and second sidewalls each comprises a corrugated panel having alternating flat, mutually parallel first and second corrugation spans respectively of substantially one hundred millimeters and one hundred and three millimeters, the spans being staggered by steeply angled intermediate connecting webs, each of the webs having a height of substantially seventeen millimeters and a span of substantially five millimeters.

2. A freight container, comprising:

a floor;

a roof;

a first end wall extending from the floor to the roof;

a second end wall extending from the floor to the roof opposite the first end wall; and mutually opposed first and second sidewalls extending from the floor to the roof and from the first end wall to the second end wall, the first and second sidewalls being made of high-strength steel having a yield strength of at least about 87,000 pounds per square inch, the sidewalls having a thickness up to one inch and defining an internal span therebetween of at least one hundred inches; and at least one group of four pallets disposed between the first end wall and the second end wall in an alternating length to width array and forming a square of one hundred inches per side, each of the pallets having a length of substantially fifty-six inches and a width of substantially forty-four inches.

3. The freight container according to claim 2, wherein:

the first end wall and the second end wall define an internal container length of at least six hundred inches therebetween; and the at least one group of pallets comprises six groups of pallets disposed within the first and second sidewalls, the first end wall, and the second end wall in a linear group array subtending a length of substantially six hundred inches.

4. The freight container according to claim 1, wherein the sidewalls are formed of a steel alloy having a high manganese content and a yield strength of at least 87,000 pounds per square inch.

5. The freight container according to claim 1, wherein the sidewalls each have a main wall portion having a sheet thickness of substantially one millimeter.

6. The freight container according to claim 1, wherein the sidewalls each have an end wall portion having a sheet thickness of substantially one and two-tenths millimeters.

* * * * *